United States Patent [19]

Cacalloro et al.

[11] Patent Number: 4,791,247

[45] Date of Patent: Dec. 13, 1988

[54] POLYESTER BUSHING AND METHOD OF MAKING SAME

[75] Inventors: Philip A. Cacalloro, Newton, N.C.; Joseph A. St. Jacques, Shreveport, La.

[73] Assignee: General Electric Company, King of Prussia, Pa.

[21] Appl. No.: 183,400

[22] Filed: Apr. 13, 1988

Related U.S. Application Data

[63] Continuation of Ser. No. 774,786, Sep. 11, 1985, abandoned.

[51] Int. Cl.[4] ..... H01B 17/20

[52] U.S. Cl. ..... 174/152 R; 156/245; 156/330; 174/153 R; 174/DIG. 10

[58] Field of Search ..... 156/242, 245, 294, 330; 174/152 R, 152 S, 153 R, DIG. 10; 427/409, 410, 417; 428/416, 458

[56] References Cited

U.S. PATENT DOCUMENTS

| | | | |
|---|---|---|---|
| 3,043,903 | 7/1962 | Keane et al. | 174/152 R |
| 3,164,488 | 1/1965 | Workman | 427/417 |
| 3,222,625 | 12/1965 | Ledocq | 174/DIG. 10 |
| 3,388,212 | 6/1968 | Nichols et al. | 174/153 |
| 3,504,106 | 3/1970 | Keto | 174/152 R |
| 3,531,580 | 9/1970 | Foster | 174/152 R |
| 3,663,928 | 5/1972 | Keto et al. | 174/152 R |
| 3,803,523 | 4/1974 | Farmer et al. | 174/152 R |
| 3,829,546 | 8/1974 | Hunter et al. | 264/262 |
| 4,112,043 | 9/1978 | Williams | 174/152 R |
| 4,514,590 | 4/1985 | Kyle | 428/416 |
| 4,614,691 | 9/1986 | Inui et al. | 156/330 |

FOREIGN PATENT DOCUMENTS

| | | | |
|---|---|---|---|
| 1213458 | 11/1970 | United Kingdom | 174/152 R |

OTHER PUBLICATIONS

Product Specificiation, Scotch-Weld Structural Adhesive 2290, 4 pages, 3M Company, St. Paul, Minn., dated Dec. 1, 1968.

*Primary Examiner*—Caleb Weston

*Attorney, Agent, or Firm*—Henry J. Policinski; William Freedman; Robert A. Cahill

[57] ABSTRACT

An improved electrical bushing is disclosed which includes, in combination, an insulating body of a polyester material, a current-carrying stud, and an adhesive coating applied to the grooved peripheral surface of the stud. The bushing is manufactured by applying the adhesive coating to the peripheral surface of the stud. The polyester insulating body is then molded about the stud. Heast is applied to concurrently cure the polyester body and adhesive coating to achieve a bonded, fluid-tight seal between the stud and the insulating body.

18 Claims, 1 Drawing Sheet

18
10
16
22
24
26
27
28
14
30
12
29
SEE 20
30
26
22
16
29

POLYESTER BUSHING AND METHOD OF MAKING SAME

This is a continuation of co-pending application Ser. No. 774,786 filed on Sept. 11, 1985 now abandoned.

BACKGROUND OF THE INVENTION

This invention relates to an improved electrical bushing and method of making the same, and more particularly to a bushing which includes a metal current-carrying stud and a polyester insulating body molded in fluid-sealing relation thereabout.

Bushings to feed current insulatively through walls of enclosures for electrical equipment are well-known. The insulating bodies of these bushings have typically been made of ceramic materials, such as porcelain, although recently the trend has been to form such bodies from an epoxy material which is molded around the current-carrying conductor or stud. For instance, in U.S. Pat. No. 3,388,212, there is disclosed a bushing having a body of molded epoxy. Typically, as the epoxy cools following molding and curing, it shrinks and grips the stud to form a good fluid seal. However, bushings whose insulating bodies are made from epoxy materials have several notable disadvantages. For instance, epoxies are susceptible to chalking upon exposure to weathering conditions. The chalked surfaces may begin to erode and become contaminated with moisture and dirt, eventually resulting in the flashover of current from the stud to the enclosure which is typically at ground potential. Furthermore, epoxy materials are generally more rigid than other plastics typically used for electrical insulation, and they require rather lengthy cure times. Moreover, epoxies generally are quite expensive as compared to most other synthetic polymers.

It is therefore an object of this invention to provide an improved electrical bushing which is less susceptible to the foregoing problems and disadvantages.

An additional object is to provide an electrical bushing of the above-character having a reliable fluid-tight seal between its current-carrying stud and the embracing insulative body.

Yet another object is to provide an electrical bushing of the above-character which is convenient to manufacture using lower cost materials, and is reliable over a long service life.

A further object of this invention is to provide a process for manufacturing a fluid-tight electrical bushing of the above-character.

It is still another object of this invention to provide an improved process for molding a polyester insulating body about a metal stud so as to form a reliable, fluid-tight seal therebetween.

These and other objects of the invention, together with the features and advantages thereof, will become apparent from the following description of the invention.

SUMMARY OF THE INVENTION

The foregoing objects are achieved by an improved electrical bushing including, in combination, an insulating body of a polyester material, a current-carrying stud, and an adhesive coating applied to the peripheral surface of the stud, wherein the body is molded about the stud in bonded, fluid-sealing relation therewith. Furthermore, the stud surface is preferably grooved or otherwise made irregular to promote adhesive bonding of the insulating body to the stud. In one method for manufacturing the bushing of the present invention, a coating of adhesive is applied to the peripheral surface of the stud. The adhesive is then air-dried for a period of time sufficient to make it tack-free. A polyester material is then molded about the adhesive-coated peripheral surface of the stud to form an insulating body which surrounds the stud while the stud and insulating body are heated for a period of time sufficient to partially cure both the polyester and adhesive. The bushing is then further heated after removal from the molding apparatus to completely cure the polyester and adhesive coating so as to form a highly reliable, bonded, fluid-tight seal between the polyester body and the stud.

DESCRIPTION OF THE INVENTION

Figures 1, 2:
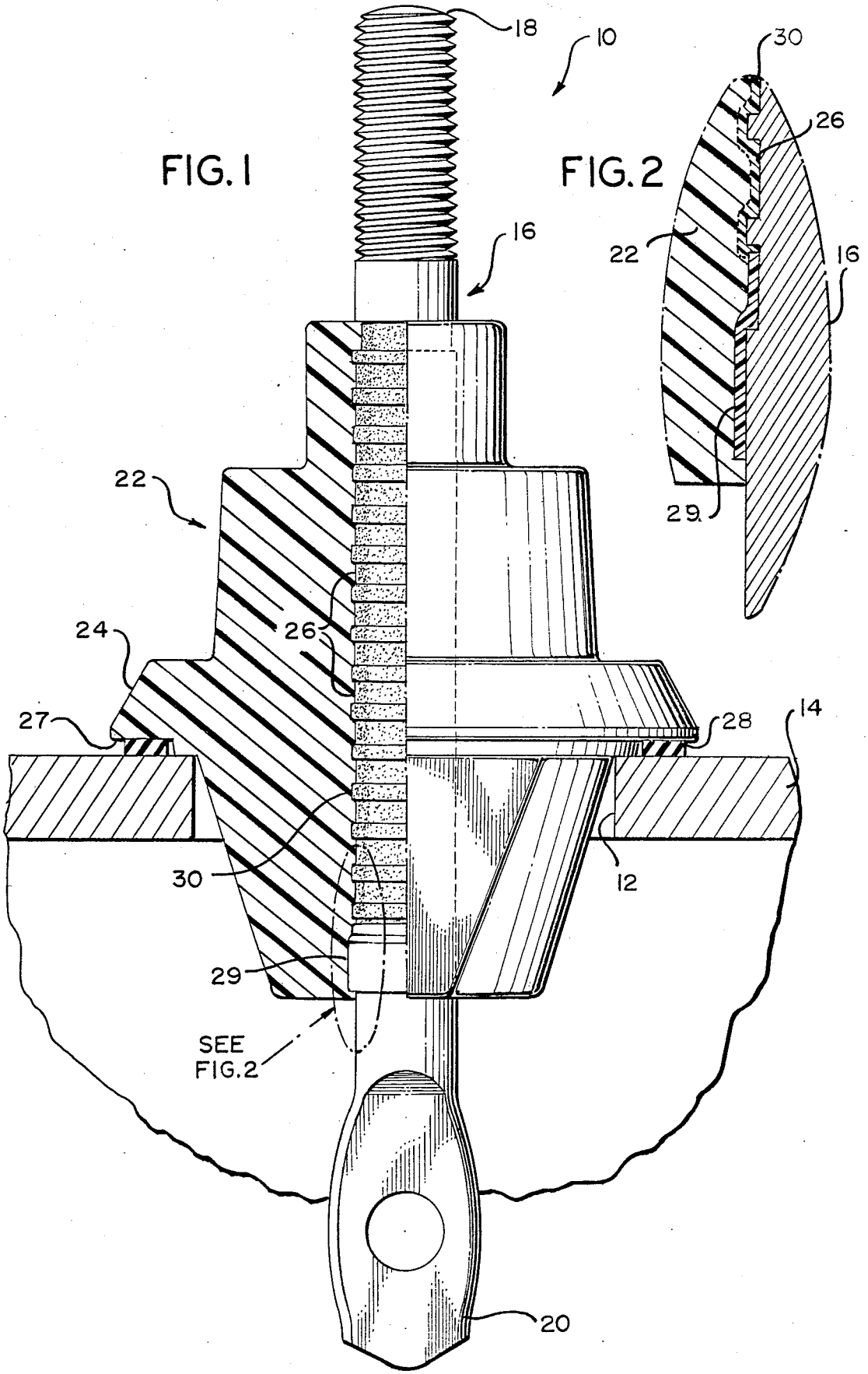
FIG. 1 is a side elevational view, partially in section, of a bushing constructed in accordance with one form of the present invention.
FIG. 2 is an enlarged fragmentary view of the indicated portion of the bushing of FIG. 1.

With reference now to the drawings, and particularly FIG. 1, a bushing in accordance with one form of the present invention is generally indicated at 10 and is shown mounted in an opening 12 provided in an enclosure wall member 14. Bushing 10 includes an elongated conductor or stud, generally indicated at 16, having an outboard end 18 adapted (threaded in the illustrated embodiment) for electrical connection to a transmission line (not shown). The inboard end 20 of stud 16 terminates within the electrical enclosure formed in part by wall member 14 for bolted electrical connection to enclosed electrical equipment, such as a distribution transformer (not shown). It will be appreciated that the configurations of the stud terminations may vary depending upon the type of joints to be employed in electrically connecting the stud to the transmission line and the enclosed electrical equipment. While stud 16 is illustrated as being in the form of a cylindrical rod, it will be appreciated that it may have other cross sectional configurations such as rectangular.

As seen in FIG. 1, an insulating body, generally indicated at 22, is molded about the peripheral surface of stud 16, intermediate its terminations 18 and 20. The body includes an integral mounting flange 24 which is formed wih an underlying gasket stop 27 accommodating a gasket 28 effective in sealing bushing 10 in opening 12 of the enclosure which in most instances is filled with a dielectric liquid. The bushing installation may be effected by various means such as bolts or clamps (not shown). Although a generally cylindrical insulating body is shown in FIG. 1, it should be understood that it may have a variety of shapes and sizes, depending upon the size and shape of enclosure opening 12, the size and shape of current-carrying stud 16, and the electrical clearances required for a particular application. In accordance with a signal feature of the present invention, insulating body 22 is formed of a polyester material, as will be fully described below.

Referring to both FIGS. 1 and 2, the stud 16 is preferably provided intermediate its terminations 18 and 20 with peripheral surface irregularities, shown to be in the form of separate circumferential grooves 26. While circumferential grooving is preferred in practicing the present invention, the surface irregularities may be created by other means, such as etching, scoring, blasting, knurling, threading, etc. As will become apparent below, these surface irregularities enhance the bonding of the insulating body to the stud and, particularly in the case of annular grooves 26, significantly increase the oversurface leakage path for dielectric fluids along the length of stud 16.

An elastomeric sleeve 29 is preferably stretch-fitted about the portion of stud 16 intermediate its inboard end 20 and grooves 26, where it is trapped between the stud and the lower terminal portion of body 22. As shown in FIG. 2, sleeve 29 overlaps a substantial portion of the lowermost annular groove 26. Thusly positioned, this sleeve can be ideally aligned with the mold gate and sprue of the molding apparatus used to form insulating body 22 and thus serves as a cushion in this typically high stress region. Also, this sleeve, which may be formed of silicone rubber, can advantageously serve as a gasket or secondary seal designed to swell upon contact with dielectric liquid attempting to leak along the interface of stud 16 and body 22. As also shown, an adhesive material 30 is uniformly coated over the grooved peripheral surface of stud 16.

In a preferred method of manufacturing the above-described electrical bushing, stud 16 is scoured by typical cleaning methods, such as vapor degreasing with trichloroethylene. This step is performed to ensure a receptive surface for the subsequently-deposited adhesive material by completely removing all plating substances and any contaminants. Grooves 26 are then cut into the stud's peripheral surface by suitable metal working equipment. It will be appreciated that the stud may be grooved or otherwise surface treated prior to the cleaning step described above.

Sleeve 29 is then fitted on the grooved and cleaned stud 16. As discussed above, the positioning of sleeve 29 depends on the location of the molding gate and sprue during the body molding step.

Preferably grooved stud 16 is then heated to temperatures up to about 250° F., and adhesive coating 30, which may be an epoxy-based material, is then applied to the stud's peripheral surface such that it fills grooves 26 and forms a continuous layer over the portion of the stud about which insulating body 22 is to be molded. Alternatively, adhesive coating 30 may be applied to the peripheral surface of the stud at room temperature; however, the application of heat speeds up the manufacturing process by allowing the adhesive to flow more easily over the stud's surface without beading. Any suitable adhesive capable of bonding molded bodies of polyester-type compounds to metal is appropriate for use in the present invention. Preferred adhesives include epoxy-type compounds, such as the Scotch-Weld Structural Adhesive 2290, a product of the 3M Company. It is found that when the molded bushing body 22 is heat-cured, adhesive coating 30 is also cured to securely bond the insulating body to the stud. The surface irregularities imparted to stud 16, such as grooves 26, in addition to displaying the attributes mentioned above, serve to entrap sufficient amounts of adhesive to ensure reliable boning. Also, sleeve 29 prevents the adhesive material from running down onto and fouling the inboard termination 20 of the stud.

After being applied to the peripheral surface of stud 16, adhesive coating 30 is air-dried to a tack-free condition. For an adhesive coating having a depth of 0.01–0.03 inches, for example, this may be accomplished by holding the stud in a vented chamber for about 7 hours to about 9 hours at about 50° F. to about 110° F. at approximately a 50% humidity level. Alternatively, the drying of the adhesive could be accomplished in an oven for a shorter period of time at a temperature of up to about 125° F. Obviously, air-drying times and temperatures will depend in part upon the particular adhesive coating used and its coating thickness.

Insulating body 22 can now be formed about the tack-free, adhesive-coated peripheral surface of stud 16 by molding a polyester material thereabout. The insulating body material may be any of a variety of polyester-type polymeric materials, such as the linear unsaturated polyesters produced by the reaction of propylene glycol with maleic anhydride and phthalic anhydride. These types of polyesters are cross-linkable at elevated temperatures when certain initiators well-known in the art are added to the compositions. One particular polyester suitable for the practice of the present invention is Dielectrite 44-10 BMC, a product of Industrial Dielectrics Inc., having an arc resistance of 180+ seconds, a heat distortion temperature of greater than 500° F. at 264 PSI, and a mold shrinkage value of 0.001–0.003 in in. Polyester materials in general have good weathering properties and require shorter cure times than other thermosetting materials, such as the epoxies, typically used in prior art electrical bushing bodies.

Many molding methods are suitable for forming the insulating body 22 of the present invention, such as injection molding, compression molding or transfer molding. The transfer molding apparatus is preferred in the practice of the present invention. Although adhesive-coated stud 16 may be at room temperature upon being placed in the molding apparatus, it is preferred that the stud be preheated to about 250° F., as the mold itself is typically preheated to a temperature of about 270° F. to about 330° F. Typically, a charge of the polyester material within the mold pot is forced down a tube through the mold gate and into cavities which surround the adhesive-coated stud. The term "molding" as used herein denotes a process that employs substantial pressure for forcing the uncured plastic into contact with the walls of the mold cavity, including the wall formed by the adhesive-coated stud 16.

After insulating body 22 has been formed about the adhesive-coated peripheral surface of stud 16 to form bushing 10, it is held in the mold at a temperature of about 270° F. to about 330° F. for about 2.5 minutes to about 4 minutes to effect partial curing of the polyester material and the dried epoxy adhesive. It will be obvious to those skilled in the art that curing times are dependent upon material compositions and body size, and will vary accordingly. For instance, the the time and temperature ranges mentioned above are typically used to effect partial curing in a bushing having a flange diameter of about 3.40 inches. After insulating body 22 and adhesive material 30 have been partially cured, the bushing is removed from the molding apparatus and heated in a conventional oven to completely cure the polyester material and the adhesive coating. Typically, cure temperatures of about 275° F. to about 350° F. for about 2–4 hours are sufficient to completely cure the materials in a bushing having a flange diameter of about 3.40 inches.

It will be apparent from the drawing and also from the exemplary dimensions given herinabove that the adhesive coating 30 is far thinner than the wall thickness of the bushing body 22. Compared to the thick wall of the massive bushing body 22, the thin adhesive coating 30 may be thought of as film-like.

The bushing formed by the above-described process provides a highly reliable, fluid-tight, electrical feed-through structure for enclosed electrical equipment, such as a distribution transformer. Furthermore, the bushing of the present invention permits a significantly shortened manufacture cycle compared to the prior art epoxy bushings because of the shorter processing times of polyester materials as opposed to the epoxy materials typically used in molded plastic bushings of the prior art. Additionally, polyester materials are substantially less costly than the epoxy materials used in the prior art bushings, thereby resulting in substantial material cost savings.

While the invention has been described with respect to preferred embodiments, it will be apparent that certain modifications and changes can be made without departing from the spirit and scope of the invention and, therefore, it is intended that the foregoing disclosure be limited only by the claims appended hereto.

What is claimed is:

1. An electrical bushing for connection at one end to a power line and at its other end to electrical apparatus including a housing through which the bushing is adapted insulatively to carry electric current between the power line and the electrical apparatus, the bushing including, in combination, (a) a massive insulating body of a polyester material.

(b) a current-carrying metal stud, and (c) a film-like adhesive coating of an epoxy-based adhesive far thinner than the wall thickness of said body applied to the peripheral surface of said stud and adhesively bonded to the metal stud, said polyester-material body being molded about said coated stud in bonded, fluid-sealing relation with said coating and said stud by (i) a molding operation that brings said polyester material in uncured condition and under substantial pressure into contact with said adhesive coating about the outer surface of said adhesive coating after said adhesive coating has dried but not fully cured and (ii) a curing operation that effects curing of said coating and said polyester material while in contact.

2. The bushing of claim 1 wherein said stud is provided with peripheral surface irregularities to promote the bonding of said insulating body to said stud.

3. The bushing of claim 2 wherein said surface irregularities are in the form of circumferential grooves.

4. The bushing of claim 2 which further includes a sleeve of elastomeric material which is expandable upon contact with fluid, said sleeve surrounding said stud at a location intermediate said stud and said body and adjacent said surface irregularities.

5. A method of manufacturing an electrical bushing having, in combination, a massive insulating body surrounding a current-carrying metal stud, said method comprising the steps of:

(a) applying a film-like adhesive coating of epoxy-based adhesive far thinner than the wall thickness of said body to the peripheral surface of said stud;

(b) molding said insulating body of a polyester material about the adhesive-coated peripheral surface of said stud by a molding operation that brings said polyester material in uncured condition and under substantial pressure into contact with said adhesive coating about the outer surface of said adhesive coating after said adhesive coating has dried but not fully cured; and (c) heating said stud and said insulating body to cure said polyester material and said adhesive coating while in contact, thereby effecting an adhesive bond between said stud and said cured coating and also a bonded, fluid-tight seal between said body and said stud through said adhesive coating.

6. The method of claim 5 further including the step of applying prior to step (a) a sleeve comprised of a silicone rubber material about said stud such as to be trapped between said stud and said body, said sleeve being expandable upon contact with electrical insulating fluids.

7. The method of claim 5 further including the step of removing contaminants from the peripheral surface of said stud prior to step (a).

8. The method of claim 5 further including the step of providing said stud with peripheral surface irregularities prior to applying said adhesive coating in step (a).

9. The method of claim 8 wherein said surface irregularities are in the form of circumferential grooves.

10. The method of claim 8 further including the step of removing contaminants from the peripheral surface of said stud prior to applying said adhesive coating in step (a).

11. The method of claim 8 further including the step of applying prior to step (a) an elastomeric sleeve about said stud such as to be trapped between said stud and said body, said sleeve being expandable upon contact with electrical insulating fluids.

12. The method of claim 11 wherein said elastomeric sleeve is comprised of a silicone rubber material.

13. The method of claim 5 further including the step of heating said stud to a temperature up to about 250° F. prior to the application of said adhesive coating in step (a).

14. The method of claim 13 further including the step of heating said adhesive-coated stud to about 250° F. prior to the molding of said insulating body in step (b).

15. The method of claim 14 further including the step of preheating a molding apparatus utilized to mold said insulating body to a temperature of about 270° F. to about 330° F.

16. The method of claim 5 wherein the molding of said polyester material in step (b) is performed at a temperature of about 270° F. to about 330° F.

17. The method of claim 16 further including the step of heating said insulating body while contained in a molding apparatus utilized to mold said insulating body for about 2.5 minutes to about 4 minutes at a temperature of about 270° F. to about 330° F. prior to step (c) to effect partial curing of said polyester material and said adhesive coating.

18. The method of claim 17 wherein said polyester material and said adhesive coating are cured in step (c) by heating said stud and said body at a temperature of about 270° F. to about 350° F. for about 2 hours to about 4 hours after removal from said molding apparatus.

* * * * *